US008826969B2

(12) United States Patent
Risberg et al.

(10) Patent No.: US 8,826,969 B2
(45) Date of Patent: Sep. 9, 2014

(54) INLET ARRANGEMENT

(75) Inventors: Tove Risberg, Rasta (NO); Stein Rune Nordtvedt, Oslo (NO); Svein Grandum, Tokyo (JP); Bjarne Horntvedt, Oslo (NO)

(73) Assignee: Institutt for Energiteknikk, Kjeller (NO)

( * ) Notice: Subject to any disclaimer, the term of this patent is extended or adjusted under 35 U.S.C. 154(b) by 662 days.

(21) Appl. No.: 11/629,335

(22) PCT Filed: Jun. 14, 2005

(86) PCT No.: PCT/NO2005/000207

§ 371 (c)(1),
(2), (4) Date: Dec. 12, 2007

(87) PCT Pub. No.: WO2005/121685

PCT Pub. Date: Dec. 22, 2005

(65) Prior Publication Data

US 2008/0216996 A1 Sep. 11, 2008

(30) Foreign Application Priority Data

Jun. 14, 2004 (NO) ..... 20042479

(51) Int. Cl.

| | |
|---|---|
| ***F25B 39/02*** | (2006.01) |
| ***F28F 9/22*** | (2006.01) |
| ***F28F 9/02*** | (2006.01) |
| ***F28D 9/00*** | (2006.01) |

(52) U.S. Cl.

CPC ..... *F28F 9/026* (2013.01); *F28D 9/005* (2013.01)

USPC ..... 165/115; 165/167; 165/174; 62/515

(58) Field of Classification Search

USPC ..... 165/167, 174, 115; 62/525, 515

See application file for complete search history.

(56) References Cited

U.S. PATENT DOCUMENTS

| | | | | |
|---|---|---|---|---|
| 3,814,172 | A * | 6/1974 | Shore | 165/167 |
| 3,976,128 | A * | 8/1976 | Patel et al. | 165/174 |
| 4,747,915 | A | 5/1988 | Pagani | |
| 5,146,980 | A | 9/1992 | Le Gauyer | |
| 6,702,006 | B2 | 3/2004 | Hohn et al. | |
| 6,868,696 | B2 * | 3/2005 | Ikuta | 62/515 |
| 7,377,307 | B1 | 5/2008 | Ijiri et al. | |

FOREIGN PATENT DOCUMENTS

| | | | | |
|---|---|---|---|---|
| DE | 3824073 | A1 * | 2/1990 | F28F 9/00 |
| DE | 3824073 | | 12/1993 | |
| JP | 04043296 | A * | 2/1992 | 165/167 |
| JP | 4-86492 | | 3/1992 | |
| JP | 5-26588 | | 2/1993 | |
| JP | 06-159969 | | 6/1994 | |

(Continued)

*Primary Examiner* — Leonard R Leo

(74) *Attorney, Agent, or Firm* — Merchant & Gould P.C.

(57) ABSTRACT

An inlet arrangement (1) for use in plate heat exchangers (2) is disclosed. The arrangement comprises an element with a dispersion opening (6) for arrangement in an inlet (5) in a plate exchanger. The inlet arrangement (1) is arranged to form a mainly fitting cylinder wall when introduced in the inlet (5). The cylinder wall comprises at least one opening (6) which extends partly or fully along the length of the inlet (5) and is sealingly arranged towards the inlet (5) of the plate heat exchanger. Furthermore, the opening (6) is oriented towards one side at an angle from the perpendicular. The use of such inlet arrangement (1) is also disclosed.

11 Claims, 3 Drawing Sheets

(56) References Cited

FOREIGN PATENT DOCUMENTS

| | | |
|---|---|---|
| JP | 06-159983 | 6/1994 |
| JP | 06159969 | 6/1994 |
| JP | 08-110123 | 4/1996 |
| JP | 08-271091 | 10/1996 |
| JP | 08-313187 | 11/1996 |
| JP | 09-166368 | 6/1997 |
| JP | 11-23181 | 1/1999 |
| JP | 11-101588 | 4/1999 |
| JP | 2001-133170 | 5/2001 |
| WO | WO 94/14021 | 6/1994 |

* cited by examiner

INLET ARRANGEMENT

This application is a 371 of PCT/NO2005/000207 filed on Jun. 14, 2005, published on Dec. 22, 2005 under publication number WO 2005/121685 A1 which claims priority benefits from Norwegian Patent Application Number 2004 2479 filed Jun 14, 2004.

THE SCOPE OF THE INVENTION

The invention relates to heat exchangers and more precisely an inlet arrangement for a plate heat exchanger.

TECHNICAL FIELD

Plate heat exchangers of various designs have been used in cooling and heating installations for a long time and are advantageous for various reasons. For example, they are compact and have a large heat exchanging surface with respect to the volume and space needed.

When using heat exchangers as drop film absorbers and/or drop film desorbers in absorption installations it has proven to be a problem to achieve a good distribution of the heat exchanging media in the exchanger. This is due to is the fact that the medium enters the exchanger as both gas and liquid phase. The gas has a tendency to concentrate in the upper part of the inlet channel. Consequently, the ducts closest to the inlet will get filled with liquid at first, so that in the ducts at the end of the inlet channel, there will mostly be flowing gas. In addition, the liquid will be flowing mostly vertically down in the heat exchanger and this will give a poor distribution of the heat exchanging media over the width of the plates. Due to the differing thermal conduction and mass flow, the heat exchanging area of the heat exchanger is therefore not optimally utilised. Such irregular distribution of liquid and gas leads to a reduced efficiency. This is often compensated for by the use of a larger heat exchanger with a larger heat exchanging surface or a tube boiler exchanger with known distribution systems and arrangements for an improved efficiency as described for example in U.S. Pat. No. 4,747,915. This leads to higher costs and an increased space demand for the installations than what is theoretically possible and desirable.

U.S. Pat. No. 6,702,006 suggests an inlet arrangement for a plate heat exchanger where the openings in the channel have a varying design to improve the distribution of media over the plates. With this arrangement, the distribution is improved by changing the direction of the flow of a part of the media and pushing it towards the openings in the channel on a cated plate. This arrangement does not establish a liquid surface or make use of gravitational forces as suggested by the present invention. This arrangement will not function in a desorber/absorber where the liquid/gas fraction is very small.

SHORT SUMMARY OF THE INVENTION

It is an important purpose of the present invention to increase the overall performance and efficiency of the heat exchanging surfaces in a heat exchanger, particularly by the application of a drop film absorber and/or a drop film desorber in a compression/absorption process.

It is furthermore an object of the invention to provide for a heat exchanger for heat exchanging media comprising a mixture of liquid and gas phase where the surface area of the heat exchanger is utilised in an improved manner. It is also desirable to provide an arrangement which easily can be used on existing plate exchangers and which comprises a simple construction which easily can be mounted in already built-up heat exchangers.

The objects and purposes of the invention are achieved by an arrangement as defined in the enclosed claims.

BRIEF DESCRIPTION OF THE DRAWINGS

An embodiment of the invention will now be described with reference to the attached drawings where.

DETAILED DESCRIPTION OF THE INVENTION

Figure 1:
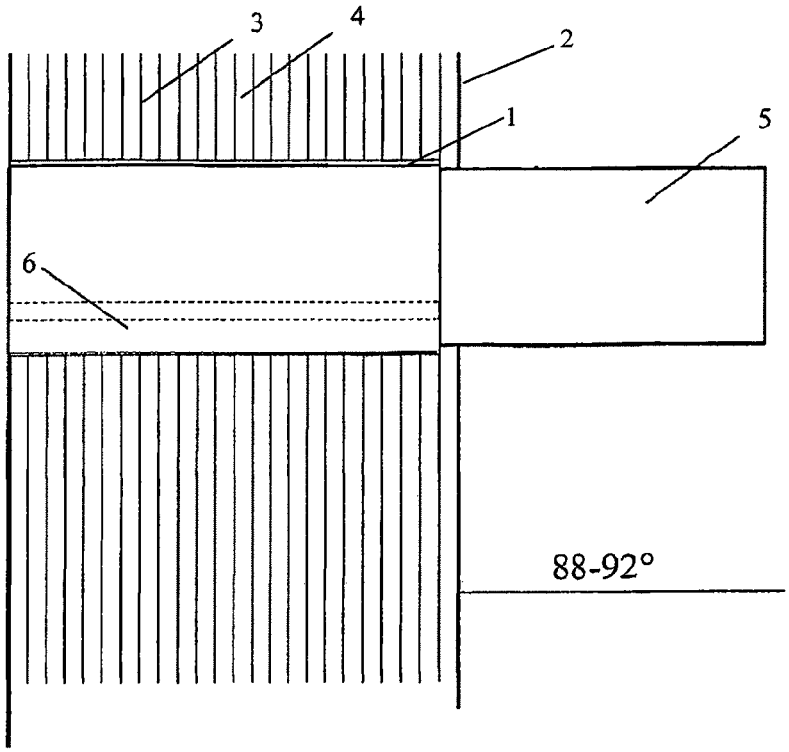
FIG. 1 shows the top in cross section of a plate heat exchanger, seen from the side, with an inlet arrangement according to the invention.
Figure 2:
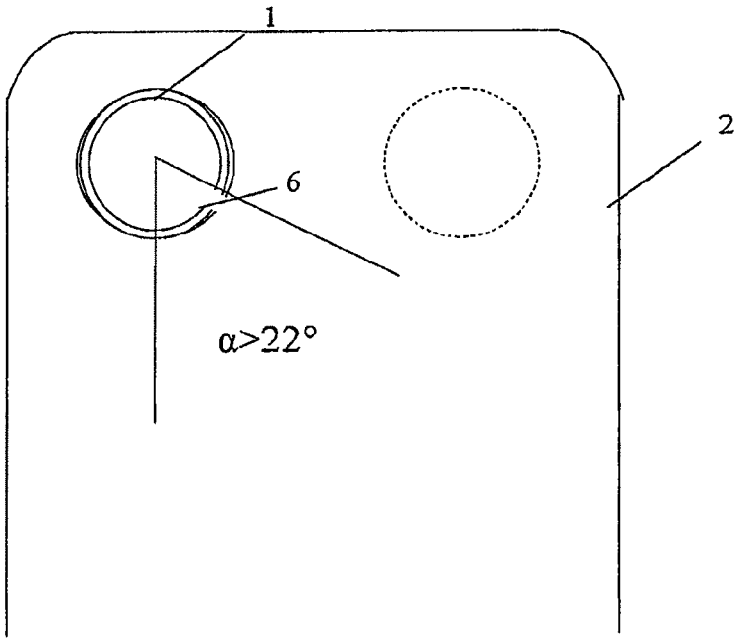
FIG. 2 shows the top of the plate exchanger of FIG. 1 with the inlet arrangement seen from the inlet.
Figure 3:
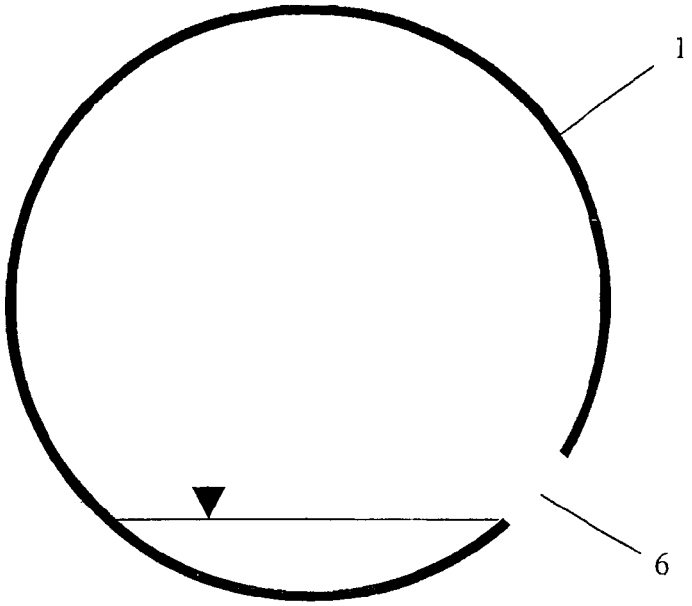
FIG. 3 shows a cross sectional view of the inlet arrangement during operation, with an indication of the level of liquid.
Figure 4:
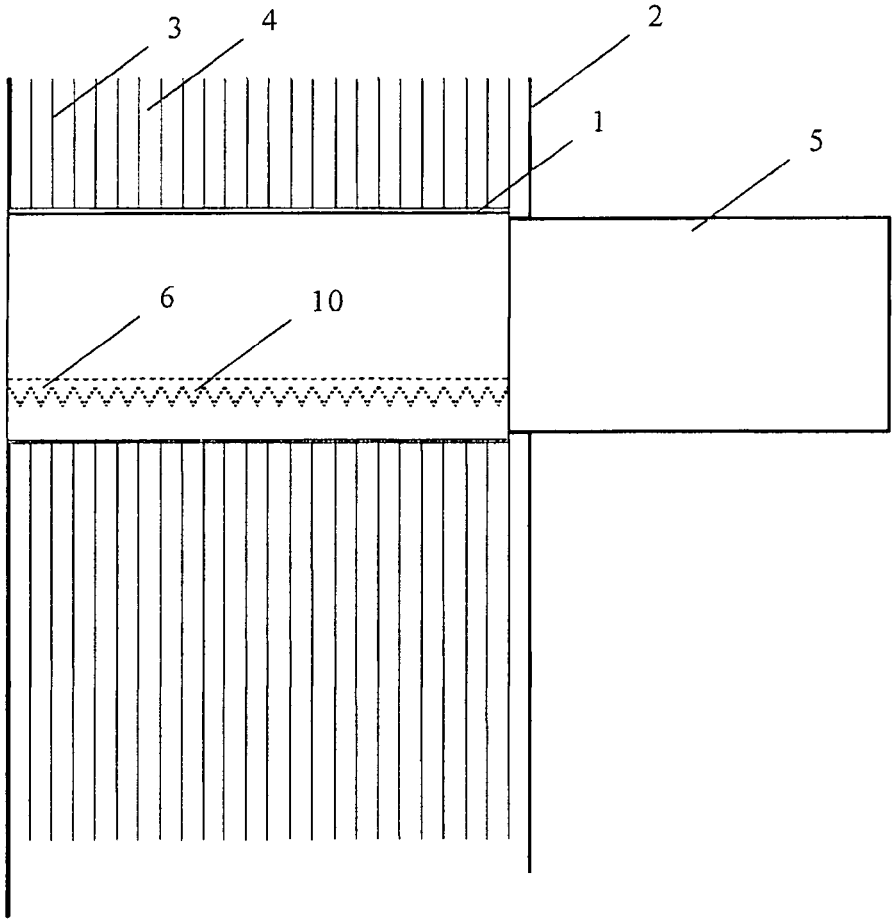
FIG. 4 shows a top in cross section of a plate exchanger, seen from the side, with an inlet arrangement according to another embodiment of the invention.

The invention relates to an inlet arrangement 1 for use in plate heat exchangers 2 as shown in the figures. An object of the arrangement is to create a liquid surface at the lower part of the inlet channel in the exchanger so that gas and liquid is distributed more evenly through all the ducts of the exchanger. FIG. 1 shows the cross section of a part of the plate heat exchanger 2 where an inlet arrangement 1 according to the invention is mounted.

The plate heat exchanger 2 comprises plates 3 designed to create a plurality of ducts 4 between the plates 3. The ducts 4 are arranged in two or more groups so that the different media can flow in separate streams through the plate heat exchanger 2. The plurality of plates 3 form a substantial heat exchanging surface and provide a good exchange of heat between the different media without any great demands for space for the heat exchanger.

The arrangement 1 according to the invention comprise a flexible steel plate or a rigid pipe which is introduced into the inlet 5 in a plate exchanger ready for use to create a cylinder wall with a longitudinal opening or slot 6. The plate is preferably long enough to cover all of the inlet depth. The breadth of the plate, however, is adjusted so that the longitudinal opening or slot 6 is created in the longitudinal direction of the inlet 5. The size of the slot 6 and thereby the size of the plate can be adjusted in each case and to different designs and sizes of the plate heat exchanger.

Figure 5:
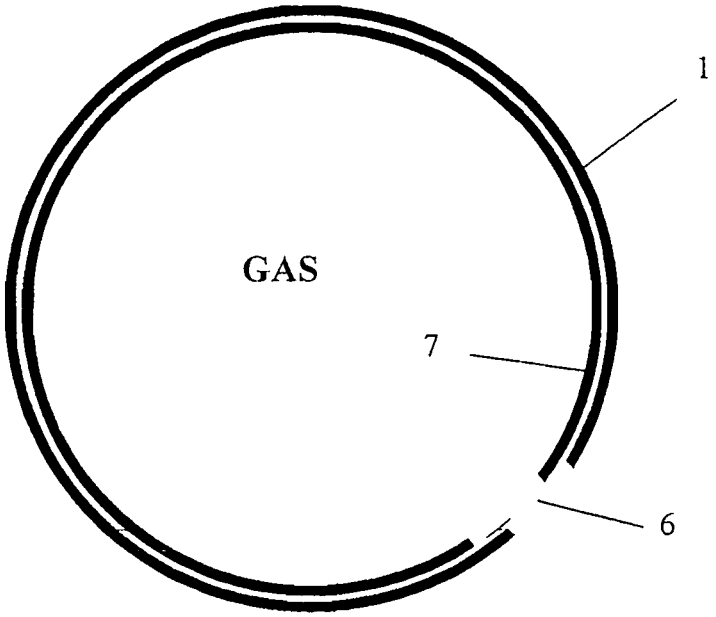
FIG. 5 shows a sectional view of an adjustable inlet arrangement according to the invention.

In a second embodiment shown in FIG. 5, the inlet arrangement 1 comprises two overlapping plates 1, 7 which can be shifted versus each other in order to change the size of the slot 6.

The width and orientation of the slot 6 can, according to one embodiment, be regulated automatically by rotating the inlet arrangement by means of a suitable driving device, such as a motor, controlled for example according to measured temperature distribution between the plates.

There is no need for additional holding means for the inlet arrangement, apart from a snug fit and sufficient resilience for the inlet arrangement to be pressed towards the heat exchanger plates. The inlet arrangement is preferably made of a resilient material. The pressure drop in the structure contributes to pressing the material towards the heat exchanger plates 3, and gives an improved tightening at the slot 6 and ends to prevent liquid from entering.

A high gas velocity though the slot 6 draws the liquid along and will at the same time give a good mixture and distribution over each plate 3 in the heat exchanger 2. The angular orientation of the slot 6 (preferably between approx. 20° and 45°) and the width of the slot 6 can be adjusted to capacity and/or quantity and the design of the plates 3. Several different duct patterns for plate heat exchangers are commercially available and the width and orientation must therefore be adjusted accordingly.

The orientation of the plate exchanger 2 relative to the vertical plane will also influence the distribution of gas and liquid through the ducts 4 of the exchanger. It can therefore be advantageously to adjust the orientation for an improved productive capacity. It has been found through experiments that the angle should preferably be between 88° and 92° in relation to the horizontal plane. The optimal angle can be found by measuring the temperature distribution between the plates 3. The practical angle is defined by geometry and gas/liquid velocity. To obtain approximately the same effect, the slot 6 of the inlet arrangement can be oriented inclined in relation to the horizontal plane.

It is clear that the angle of the plate exchanger also can be regulated automatically in relation to the temperature distribution over the exchanger, for example by means of a suitable control unit with an associated motor operator.

Approximately the same effect as with the above mentioned declined position of the exchanger, can be obtained by narrowing the slot 6 inwards from the inlet of the heat exchanger to compensate for the built-up of pressure and accumulation of liquid at the end of the inlet channel 5.

The dispersion of liquid in the inlet arrangement will vary with the velocity of the media. The best possible geometry of the inlet arrangement can therefore also vary. This is among others dependent on the surrounding operating conditions, regulation of capacity, utilization of the system, etc. When the inlet arrangement comprises two elements as described above, the geometry can be varied, for example by means of a power driven device forming part of the control loop. It is also possible to use an arrangement equivalent to the one used for changing of the angle of the heat exchanger.

The inlet arrangement has a sharp edge 9 along the slot. This edge will create turbulence and efficiently mix gas and liquid and accordingly improve the distribution.

In order to reduce the dependency of the optimal angle for the inlet arrangement, the sharp edge can be supplied with triangular recesses 10 (like a V-groove) to create a V-shaped overflow edge securing a minimum level of liquid in each duct 4 when the level of liquid rises above a minimum.

Figure 6:
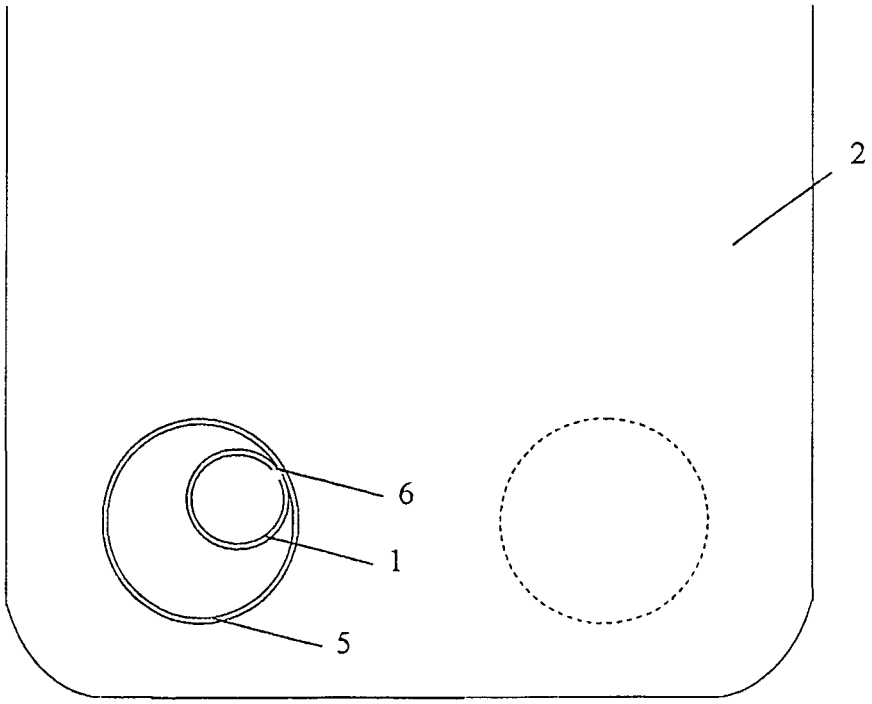
FIG. 6 shows the lower part in cross section of a plate heat exchanger, seen form the side, with an inlet arrangement according to a third embodiment of the invention.

In one embodiment shown in FIG. 6, the inlet arrangement has a tubular design and is attached to one or both ends of the inlet. The inlet arrangement according to this embodiment has a diameter which is smaller than the diameter of the inlet and will therefore not completely seal the inlet. However, the opening of the inlet arrangement will abut on the inlet. One end of the inlet arrangement is placed towards the back wall or is sealed by a plate. This embodiment is suitable when the plate exchanger is a bubble absorber. The gas enters the inlet arrangement and the liquid enters adjacent thereto.

In principle, it is possible to send both liquid and gas into the inlet arrangement so that the bubbles will entrain the liquid when passing through the slot. Gas and liquid is supplied continuously to prevent the liquid from remaining in the inlet arrangement.

It has been found that the inlet arrangement 1 according to the invention in some cases triples the heating/cooling output for plate heat exchangers used as absorbers/desorbers.

The invention claimed is:

1. A plate heat exchanger system, comprising:

a plurality of plates;

a plurality of ducts defined by spaces between the plates;

a support structure arranged and configured to support the plates in a substantially vertical orientation;

an inlet arrangement consisting essentially of a cylindrical tube supported by at least some of the plurality of plates in a substantially horizontal orientation, the cylindrical tube having a single longitudinal opening that extends along a length of tube in a side of the tube, wherein the opening is directed toward a main heat exchanging area of the plate heat exchanger system, the opening including a lower edge, wherein the cylindrical tube includes a liquid delivery portion arranged at least partially below the lower edge and a gas delivery portion arranged at least partially above the lower edge;

a liquid supplying device configured to supply liquid to the liquid delivery portion of the inlet arrangement; and a gas supplying device configured to supply gas to the gas delivery portion of the inlet arrangement;

wherein the inlet arrangement is arranged and configured to supply the liquid and the gas to at least some of the plurality of ducts.

2. The plate heat exchanger system of claim 1, wherein the plurality of plates and the plurality of ducts are arranged in a falling film absorber/desorber configuration.

3. The plate heat exchanger system of claim 1, wherein the plurality of plates are between about 88 degrees and about 92 degrees from a horizontal plane.

4. The plate heat exchanger system of claim 1, wherein the cylindrical tube is between about 88 degrees and about 92 degrees from a vertical plane.

5. The plate heat exchanger system of claim 1, wherein the cylindrical tube forms a barrier to liquid passage except through the opening.

6. The plate heat exchanger system of claim 1, wherein the cylindrical tube includes only one longitudinal opening, and wherein the lower edge of the opening is a sharp edge.

7. The plate heat exchanger system of claim 1, wherein an angle between a vertical plane parallel to a central axis of the cylindrical tube and a plane parallel to the central axis and the lower edge is larger than 20 degrees.

8. The plate heat exchanger system of claim 7, wherein the angle is between about 22 degrees and about 45 degrees.

9. The plate heat exchanger system of claim 1, wherein the cylindrical tube is formed of a resilient material in the form of at least one plate.

10. The plate heat exchanger system of claim 1, wherein the opening extends along the entire length of the tube.

11. The plate heat exchanger system of claim 1, wherein the liquid delivery portion of the tube forms a liquid barrier that prevents liquid from passing from the liquid delivery portion to the ducts without passing through the opening.

* * * * *